US006728973B1

(12) United States Patent
Webley et al.

(10) Patent No.: US 6,728,973 B1
(45) Date of Patent: May 4, 2004

(54) UNDERGARMENT

(75) Inventors: Rachel Webley, Nottingham (GB); Valentina Collins, Nottingham (GB)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 10/069,219

(22) PCT Filed: Aug. 24, 2000

(86) PCT No.: PCT/GB00/03263

§ 371 (c)(1),
(2), (4) Date: Nov. 1, 2002

(87) PCT Pub. No.: WO01/13747

PCT Pub. Date: Mar. 1, 2001

(30) Foreign Application Priority Data

Aug. 24, 1999 (GB) ..... 9919969

(51) Int. Cl.[7] ..... A41B 9/00

(52) U.S. Cl. ..... 2/400; 2/406; 450/94; 450/115

(58) Field of Search ..... 2/400, 406, 69, 2/228, 238, 227; 450/94, 97, 101, 115, 116, 117, 118, 122–124, 130, 131, 132, 99, 151, 155, 156; 482/105, 121; 66/177, 172 E, 191

(56) References Cited

U.S. PATENT DOCUMENTS

| | | | | | |
|---|---|---|---|---|---|
| 3,756,247 | A | * | 9/1973 | Hand | 450/96 |
| 3,894,542 | A | * | 7/1975 | Sacristan | 450/96 |
| 4,538,615 | A | * | 9/1985 | Pundyk | 450/96 |
| 4,698,847 | A | * | 10/1987 | Yoshihara | 2/69 |
| 5,201,074 | A | * | 4/1993 | Dicker | 2/69 |
| 5,590,548 | A | * | 1/1997 | Osborne | 66/177 |
| 5,888,118 | A | * | 3/1999 | Kishi | 450/122 |
| 5,954,564 | A | * | 9/1999 | Ganz | 450/99 |

FOREIGN PATENT DOCUMENTS

| | | | | |
|---|---|---|---|---|
| WO | WO99/53779 | * | 10/1999 | 450/96 |

* cited by examiner

*Primary Examiner*—Gloria M. Hale
(74) *Attorney, Agent, or Firm*—Ohlandt, Greeley, Ruggiero & Perle, L.L.P.

(57) ABSTRACT

An undergarment having a body portion and a pair of depending leg portions having a crotch region located therebetween with the body and leg portions being integrally formed from a single blank of warp knitted fabric. The opposed side edges of the blank being seamed together to define the body and leg portions. The blank is knitted to define compressive regions in the blank with different compressive strengths and being knitted to define stretch regions in the blank which have different stretch characteristics with the positional location, the size and shape of the regions being predetermined to provide desired shaping characteristics of the garment.

7 Claims, 2 Drawing Sheets

UNDERGARMENT

The present invention relates to an undergarment, in particular an undergarment capable of shaping the buttocks of the wearer.

According to one aspect of the present invention there is provided an undergarment having a body portion and a pair of depending leg portions having a crotch region located therebetween, said body and leg portions being integrally formed form a singe blank of warp knitted fabric opposed side edges of the blank being seamed together to define said body and leg portions, the blank being knitted to define compressive regions in the blank having different compressive strengths and being knitted to define stretch regions in the blank which have different stretch characteristics, the positional location, the size and shape of said regions being predetermined to provide desired shaping characteristics of said garment.

According to another aspect of the present invention there is provided a blank for forming a garment as defined above.

Various aspects of the present invention are hereinafter described with reference to the accompanying drawings, in which.

Figure 2:
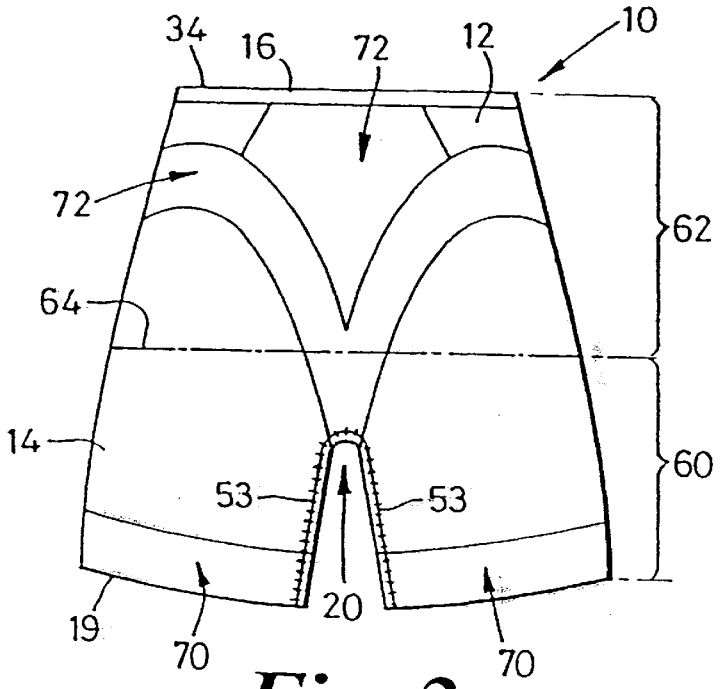
FIG. 2 is a front view of the garment formed from the blank of FIG. 1
Figure 3:
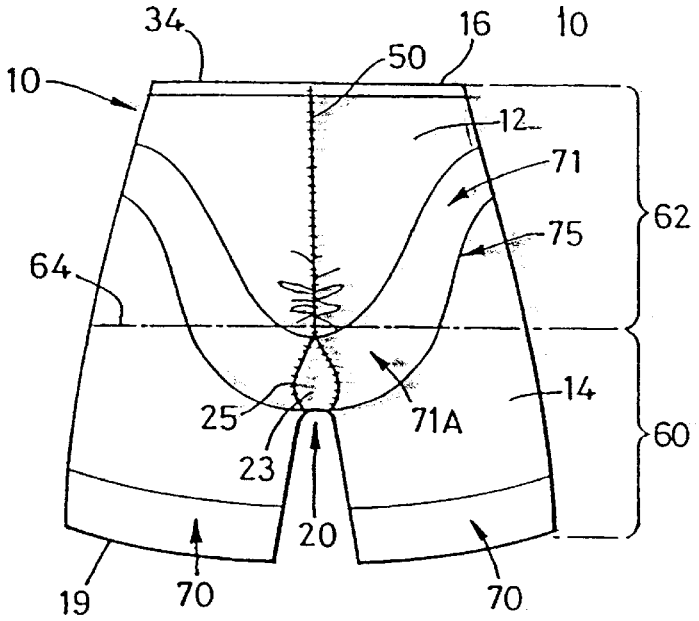
FIG. 3 is a rear view of the garment formed from the blank of FIG. 1.

The undergarment 10 shown in FIGS. 2 & 3 includes a body portion 12 from which depends a pair of leg portions 14. The body portion 12 includes a waist opening which is preferably surrounded by an elasticated waistband 16.

The leg portions 14 are separated by a crotch region 20 formed at the lower region of the body portion 12. Preferably a separately formed crotch insert 23 is located at the crotch region 20 by a seam 25.

Figure 1:
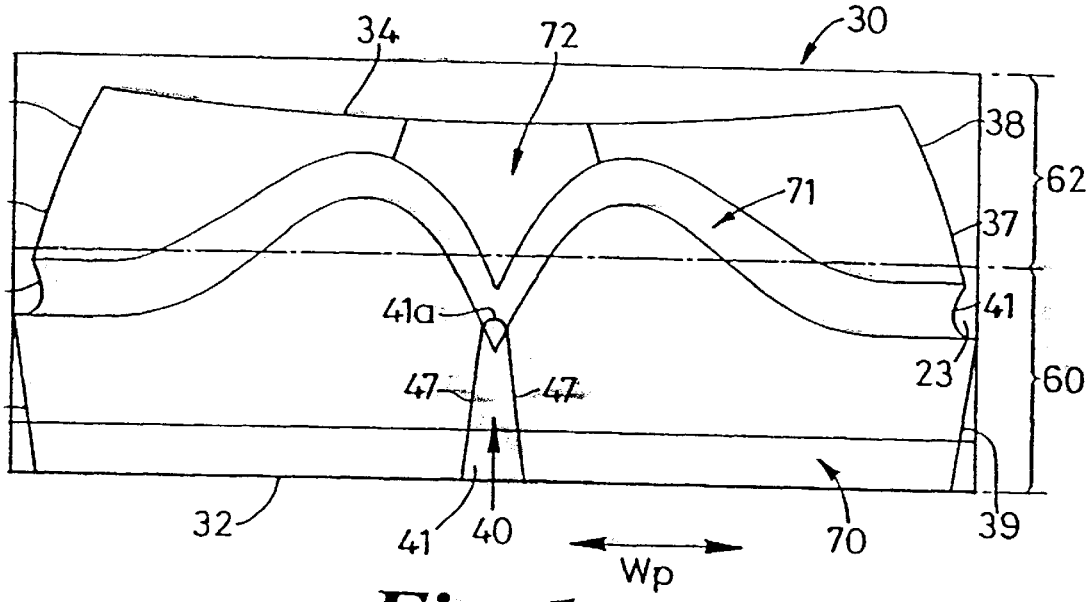
FIG. 1 is a plan view of a blank for forming a garment according to an embodiment of the present invention.

The garment 10 is formed from a blank 30 illustrated in FIG. 1.

The blank 30 is warp knitted, preferably on a jacquard controlled warp knitting machine for example of the type described in U.S. Pat. No. 5,628,210; the direction of the warp being indicated by arrow $W_p$. The lower edge 32 of the blank is preferably knit to define a selvedge which in the finished garment forms the leg openings 19 at the lower terminal end of the leg portions 14.

The provision of a selvedge along edge 32 avoids the need to fold and/or seam the fabric and therefore enable the terminal end of the leg portions to lie flat against the skin of the wearer. This is advantageous when wearing garment 10 under a tight fitting overgarment as the lower end of the leg portions will not create a bulge and will not therefore be visible.

The upper edge 34 is preferably cut to shape. A waistband (not shown) is created along edge 34 and in so doing, the edge 34 is secured against untangling. The waistband may be created by folding over a marginal portion of the fabric adjacent edge 34 to create a tube into which an elasticated ribbon is inserted. Alternatively, an elasticated ribbon may be directly seamed along edge 34.

The side edges 36,37 of the blank 30 extend generally in the coursewise direction between upper edge 34 and lower edge 32 and are formed by a cutting operation. Each side edge includes a body forming edge portion, 38 and a leg forming edge portion 39. If a crotch insert is to be provided, a cut out 41 is provided inbetween edges 38,39 for forming a crotch opening into which crotch insert 23 may be inserted. At a central location along the blank 30 a slit 40 is formed running inwardly from edge 32. The slit defines a pair of leg forming edges 47 connected by a crotch forming edge portion 41*a*.

To construct the garment shown in FIG. 2, the blink 30 is folded to align body forming edges 38 and these edges are joined by a seam 50. Leg forming edges 39 and a respective one of edges 47 are aligned and seamed is together by seams 53 to form the leg portions.

Crotch insert is then inserted into the crotch opening and secured into position by seam 25.

As seen from FIGS. 2 & 3, the garment formed from blank 30 has a body portion which only has a single seam 50 located on the ear of the garment and a pair of seams 53 which are located on the inside of each leg portion. Accordingly, the front and sides of the body portion are completely free of seams. Also the seam 50 located at the rear of the body portion is positioned centrally and extends inbetween the cheeks of the buttocks in wear. Accordingly the body portion provides a smooth appearance when worn.

Similarly since the seams 53 are located on the inside of the legs of the wearer, the leg portions also provide a smooth appearance when the garment is being worn.

Thus when located under a tightly fitting overgarment, the garment 10 creates no bulges and so is invisible.

The provision of a minimum number of seams and the location of those seams which are provided help to make the garment of the present invention comfortable to wear.

In order to provide a shaping effect, the fabric of the blank 30 is knitted to provide different compressive regions which have different compressive characteristics and also stretch regions which have different stretch characteristics.

The different compressive characteristics are preferably achieved by the incorporation of different strengths of elastomeric yarn, such as LYCRA in different regions of the blank 30.

The different stretch characteristic&-re preferably achieved by the adoption of different stitch structures in different regions of the blank 30. A particular stretch region may extend solely within a given compressive region or may extend from one compressive region into another compressive region.

The positional location of the compressive and stretch regions and their shape and size within the blank 30 are predetermined in order to provide the desired shaping and smoothing characteristics for the garment. An example of the position, shape and size of these regions is illustrated in the blank 30 of FIG. 1 and the garment shown in FIGS. 2 & 3.

In blank 30 two different compressive regions 60,62 are provided. Both regions extend throughout the length of the blank 30 from one side edge 36 to the other side edge 37 (ie. direction $W_p$) and are immediately adjacent to one another in the coursewise direction of the knitted fabric to define a boundary line 64.

During knitting art elastomeric yarn is introduced into each region 60, 62 in order to provide each region with the desired compressive strength. This may be achieved by using elastomeric yarns of different dtex values in each region or by introducing elastomeric yarns of the same dtex value into each region but supply a different number of yarn ends to each needle position. The elastomeric yam may be incorporated by forming knitted stitches and/or by being laid-in along wales formed in the knitted fabric.

Preferably in the garment of the present invention, region 60 is knitted so as to have a higher warpwise compressive strength than region 62 and the boundary line 64 is located so as to be in the lower region of the body portion in the vicinity of the crotch region. Thus when worn, the boundary line is intended to be located just beneath the cheeks of the buttocks of the wearer. Accordingly due to the higher warpwise compressive strength of region 60, the upper thighs are compressed to give a smooth rounded shape and the lower part of the buttocks is raised. The lower compressive strength of region 62 enables the raising of the lower region of the buttocks to occur and also compresses the cheeks of the buttocks to give a smooth rounded appearance.

The shaping effect of the compressive regions 60,62 is modified by the stretch regions 70, 71 and 72. Stretch region 71 is in the form of a relatively narrow band which undulates, in a generally sinusoidal manner, along the blank 30 (ie. in direction $W_p$) from crotch cut out at one side of the blank to the crotch cut out at the other side of the blank. The stitch structure of region 71 is such that it provides less stretch, preferably in both the wale and course directions, than the immediately surrounding fabric.

As seen in FIG. 3, the position and shape of region 71 creates a sling 75 which extends from beneath the lower region of the buttocks of the wearer and upwards on both sides toward the waistband.

The lower portion 71*a* of region 71 extends into compressive region 60 and so portion 71*a* has less stretch in this portion of region 60. This restriction in stretch helps to compliment the lifting function of compressive region 60.

The upward extent of region 71 preferably terminates at a position just above the hips of the wearer whereat it then is directed downwardly as it extends in the front of the body. Thus the sling 75 is spaced from the waistband and helps to prevent bulging of flesh in the hip region by providing restricted stretch in that region.

Stretch region 72 is preferably formed of a stitch structure which has less stretch, preferably in both the course and wale wise directions, than the surrounding fabric. Preferably the fabric of region 72 has little or no stretch. The region is positioned at the front of the body portion to define a tummy panel and due to its stretch characteristics helps restrict tummy bulge.

Stretch region 70 forms a marginal region around the leg openings. Region 70 is formed of a stitch structure which has less stretch, preferably both in the coursewise and wale wise directions, than the surrounding fabric. In this way, the marginal region about each leg opening tends to grip the leg of the wearer and helps resist the leg portion rising up the leg of the wearer.

Figure 4:
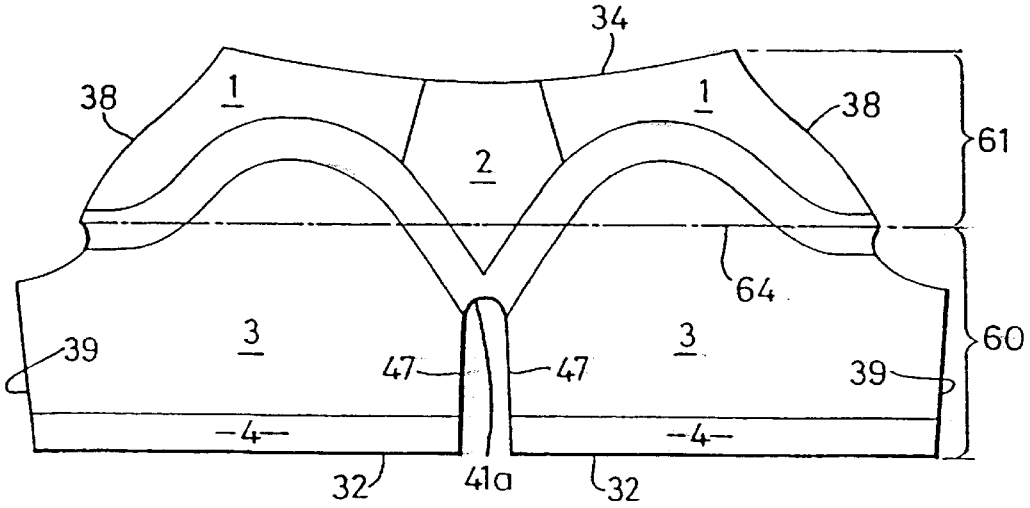
FIG. 4 is a schematic plan view of the blank shown in FIG. 1 after cutting from the sheet fabric.

It will be appreciated that incorporation of stretch regions 70, 71 and 72 in effect divides the garment into distinct panels 1, 1*a*, 2, 3 and 4 as schematically illustrated in FIG. 4 and that the compressive modulus in these different panels varies depending upon the stretch characteristics of the knitted fabric structure of the stretch region and the compressive strength of the compressive region 60, 61.

By way of example, the compressive region 60 is knit incorporating an elastomeric yarn, LYCRA (RTM) of about 450 to 500 dtex, preferably about 475 dtex and the compressive region 61 is knit incorporating an elastomeric yarn, LYCRA (RTM) of about 260 to 300 dtex, preferably about 285 dtex.

Suitable stitch structures are adopted for the ground fabric for producing the main fabric of the body and leg portions and are adopted for the stretch regions 70, 71 and 72 so as to produce the following preferred values for panels 1, 2, 3 and 4, viz.

| | ZONE 1 | ZONE 2 | ZONE 3 | ZONE 4 |
|---|---|---|---|---|
| Warp Modulus | 200–400 g | 330–530 g | 400–600 g | 500–700 g |
| Warp Stretch | 130–190% | 90-130% | 125–155% | 95–145% |

The modulus value is determined by a textile measuring Istron Machine, with 3.5 kg loading at 40% extension.

The embodiment described above is an undergarment in the form of a pair of panties. It will be appreciated that the principles of the invention, viz. the provision of a warp knit blank having at least 2 warpwise extending compressive band regions of differing compressive strengths and stretch regions having predetermined stretch characteristics which co-operate with the compressive band regions to provide panels within the blank having predetermined warpwise compressive moduli may be utilised for the creation of other types of garment.

What is claimed is:

1. An undergarment having a body portion and a pair of depending leg portions having a crotch region located therebetween, said body and leg portions being integrally formed from a single blank of warp knitted fabric, opposed side edges of the blank being seamed together to define said body and leg portions, the blank being knitted to define at least two compressive regions in the blank, each of said at least two compressive regions having different compressive strengths, and at least one band being knitted in said at least two compressive regions to define a region with less stretch in a coursewise and walewise direction than fabric in said at least two compressive regions the size and shape of said region being predetermined to provide desired shaping characteristics of said garment.

2. The undergarment according to claim 1, wherein said at least two compressive region extending extend from one of said side edges to the other of said side edges.

3. The undergarment according to claim 2, wherein one of said at least two compressive regions extends from a lower edge of the blank to a boundary edge with a second one of said at least two compressive regions, said boundary edge being located within said body portion of the undergarment.

4. The undergarment according to claim 1, wherein said band extends in a generally sinusoidal manner from one of said opposed side edges to the other of said opposed side edges to define a buttock support.

5. The undergarment according to claim 1, further comprising a second band, wherein said second band is an only one of said at least two compressive regions.

6. The undergarment according to claim 5, wherein said second band extends along the lower edge of the blank defining marginal regions about said leg openings of said leg portions, said marginal band having less stretch than adjacent fabric of said leg portions.

7. An undergarment with a body portion and a pair of depending leg portions with a crotch region located therebetween, said body and leg portions being integrally formed from a single blank of warp knitted fabric, opposed side edges of the blank being seamed together to define said body and leg portions, the blank being knitted to define:

at least two compressive regions in the blank, each of said at least two compressive regions having different compressive strengths, a first band being knitted in said at least two compressive regions to define a region with less stretch in a coursewise and walewise direction than fabric in said at least two compressive regions, and a second band, wherein said second band is in only one of said at least two compressive regions.

* * * * *